US009376780B2

(12) United States Patent
Perry et al.

(10) Patent No.: US 9,376,780 B2
(45) Date of Patent: Jun. 28, 2016

(54) JACKUP DEPLOYED RISER PROTECTION STRUCTURE

(71) Applicants: Offshore Technology Development Pte Ltd, Singapore (SG); Keppel Offshore & Marine Technology Centre Pte Ltd, Singapore (SG)

(72) Inventors: Michael John Perry, Singapore (SG); James Benton Davis, Houston, TX (US); Kok Seng Foo, Singapore (SG); Cynthia Wang, Singapore (SG)

(73) Assignees: Offshore Technology Development Pte Ltd, Singapore (SG); Keppel Offshore & Marine Technology Centre Pte Ltd, Singapore (SG)

( * ) Notice: Subject to any disclaimer, the term of this patent is extended or adjusted under 35 U.S.C. 154(b) by 0 days.

(21) Appl. No.: 14/529,121

(22) Filed: Oct. 30, 2014

(65) Prior Publication Data

US 2015/0139737 A1 May 21, 2015

Related U.S. Application Data

(60) Provisional application No. 61/901,465, filed on Nov. 8, 2013.

(51) Int. Cl.

| | |
|---|---|
| ***E02B 17/02*** | (2006.01) |
| ***E02B 17/08*** | (2006.01) |
| ***E02B 17/00*** | (2006.01) |

(52) U.S. Cl.

CPC ..... *E02B 17/08* (2013.01); *E02B 17/0004* (2013.01); *E02B 17/028* (2013.01); *E02B 17/021* (2013.01); *E02B 2017/0073* (2013.01); *E02B 2017/0095* (2013.01)

(58) Field of Classification Search

CPC ..... E02B 2017/0095; E21B 15/003; E21B 15/02; E21B 17/01; E21B 17/017; E21B 19/002; E21B 19/004

USPC ..... 405/216

See application file for complete search history.

(56) References Cited

U.S. PATENT DOCUMENTS

| | | | | |
|---|---|---|---|---|
| 3,508,409 | A * | 4/1970 | Cargile, Jr. | 405/195.1 |
| 3,602,319 | A * | 8/1971 | Graham | E21B 17/017 138/155 |
| 4,244,663 | A * | 1/1981 | Croghan | 405/195.1 |

FOREIGN PATENT DOCUMENTS

RU 2011149365 A 6/2013

OTHER PUBLICATIONS

Office Action of Russian patent application No. 2014144940 mailed Feb. 1, 2016 (6 pages).

* cited by examiner

*Primary Examiner* — Tara M. Pinnock
(74) *Attorney, Agent, or Firm* — Pyprus Pte Ltd

(57) ABSTRACT

A jackup deployed riser protection structure comprises a plurality of coupler receivers disposed onto a jackup hull, a tubular sleeve, wherein the tubular sleeve is a hollow structure that allows a riser to pass through, a support structure coupled with the tubular sleeve to provide support for the tubular sleeve, and a plurality of couplers coupled with the support structure, wherein each of the plurality of couplers is coupled with one of the plurality of coupler receivers, so that the jackup deployed riser protection structure is supported by the jackup hull in order to provide protection to the riser.

6 Claims, 22 Drawing Sheets

JACKUP DEPLOYED RISER PROTECTION STRUCTURE

CROSS REFERENCE TO RELATED APPLICATIONS

This application claims the benefit under 35 U.S.C. 119(e) of U.S. Provisional Application No. 61/901,465, filed Nov. 8, 2013, which is herein incorporated by reference.

FIELD OF THE INVENTION

The present invention relates generally to the technology of offshore platforms, and more particularly to a jackup deployed riser protection structure suitable for providing protection to a riser from forces due to impact with sea ice.

BACKGROUND OF THE INVENTION

When a jackup platform drills wells in locations that may be subject to sea ice, the risers need to be protected from forces due to impact with the sea ice. The existing options for doing so include:

1. Drilling with the riser unprotected;
2. Providing coatings to the riser to protect against corrosion, fouling etc, but without protection from large ice or ship impacts;
3. Drilling through a minimal wellhead platform which supports the wellhead and conductor but is not designed to provide protection from large forces, for example ice impacts;
4. Drilling through a substantial protection structure such as a conical piled monopod (CPM); and
5. Drilling from a large combined drilling and production platform.

Options 3, 4 and 5 are all permanent structures and cannot be easily removed for reuse when the drilling activity is complete and not economical for exploration drilling where only one well is drilled at a location. As they are permanent they must also be designed for the worst possible design conditions as they cannot be removed if unusually large forces are expected.

SUMMARY OF THE INVENTION

One aspect of the present invention provides a jackup deployed riser protection structure suitable for being employed in a jackup platform. In one embodiment, the jackup deployed riser protection structure comprises a plurality of coupler receivers disposed onto a jackup hull, a tubular sleeve, wherein the tubular sleeve is a hollow structure that allows a riser to pass through, a support structure coupled with the tubular sleeve to provide support for the tubular sleeve, and a plurality of couplers coupled with the support structure, wherein each of the plurality of couplers is coupled with one of the plurality of coupler receivers, so that the jackup deployed riser protection structure supports the riser by the jackup hull.

In another embodiment of the jackup deployed riser protection structure, the support structure comprise two triangle frames extending from the tubular sleeve at a predetermined angle, wherein each triangle frame comprises, a horizontal beam with one proximity end and a distal end, a slope beam with one proximity end and a distal end, a vertical beam with one top end and a bottom end, and a diagonal beam with one proximity end and a distal end, wherein the proximity ends of the horizontal beam and slope beam are coupled to the tubular sleeve at higher coupling points and the proximity end of the diagonal beam to the tubular sleeve at a lower coupling point, wherein the distal ends of the horizontal and slope beams are coupled to form a distal juncture, wherein the distal end of the diagonal beam is coupled to the slope beam at a middle point, and wherein the top and bottom ends of the vertical beam are coupled to a middle point of the horizontal and slope beams respectively. In yet another embodiment of the jackup deployed riser protection structure, the support structure further comprises two horizontal members and two cross members for bracing the two triangle frames; wherein all four brace members are coupled to the middle points of the horizontal beam and slope beam.

In another embodiment of the jackup deployed riser protection structure, each of the triangle frames is disposed with at least two of the plurality of couplers at the distal juncture and the middle point of the horizontal beam.

In another embodiment of the jackup deployed riser protection structure, the tubular sleeve comprises one partial tubular for coupling to the support structure and another partial tubular that is separable from or movably coupled with the one partial tubular; thereby when the two partial tubular are assembled, the riser passes through it.

In another embodiment of the jackup deployed riser protection structure of claim 1, wherein the tubular sleeve comprises one partial tubular for coupling to the support structure and a plurality of clamps that are separable from or movably coupled with the one partial tubular; thereby when the one partial tubular and plurality of clamps are assembled, the riser passes through it. In a further embodiment, the jackup deployed riser protection structure further comprises a second tubular sleeve that is gripped by the tubular sleeve; so that the riser passes through the second tubular sleeve.

Another aspect of the present invention provides a jackup drilling platform. In one embodiment, the jackup drilling platform comprises a jackup hull, a plurality of legs slidably passing through the jackup hull for providing support to the jackup hull, a riser for being used during drilling operation and a jackup deployed riser protection structure comprising a plurality of coupler receivers disposed onto a jackup hull, a tubular sleeve, wherein the tubular sleeve is a hollow structure that allows the riser to pass through, a support structure coupled with the tubular sleeve to provide support for the tubular sleeve, and a plurality of couplers coupled with the a support structure, wherein each of the plurality of couplers is coupled with one of the plurality of coupler receivers, so that the jackup deployed riser protection structure is supported by the jackup hull in order to provide protection to the riser.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

The present invention provides a jackup deployed riser protection structure designed for providing protection to a riser when drilling from a jackup drilling platform. In principle, it is designed to be deployable from and substantially supported by the jackup platform. It should be noted that in the figures presented here, the jackup platform is depicted with four square ice strengthened legs, however it is to be appreciated that other jackups and leg arrangements could be used without affecting the nature of the present invention. In particular, jackups with three or four legs, where each leg is of square or triangular configuration, are likely to be used. Such jackups would likely have, for example, tubular, trussed or ice plated legs. The jackup rig shown in this disclosure is therefore intended as an illustration only and should not limit the intended applicability of the invention described herein.

Figure 1:
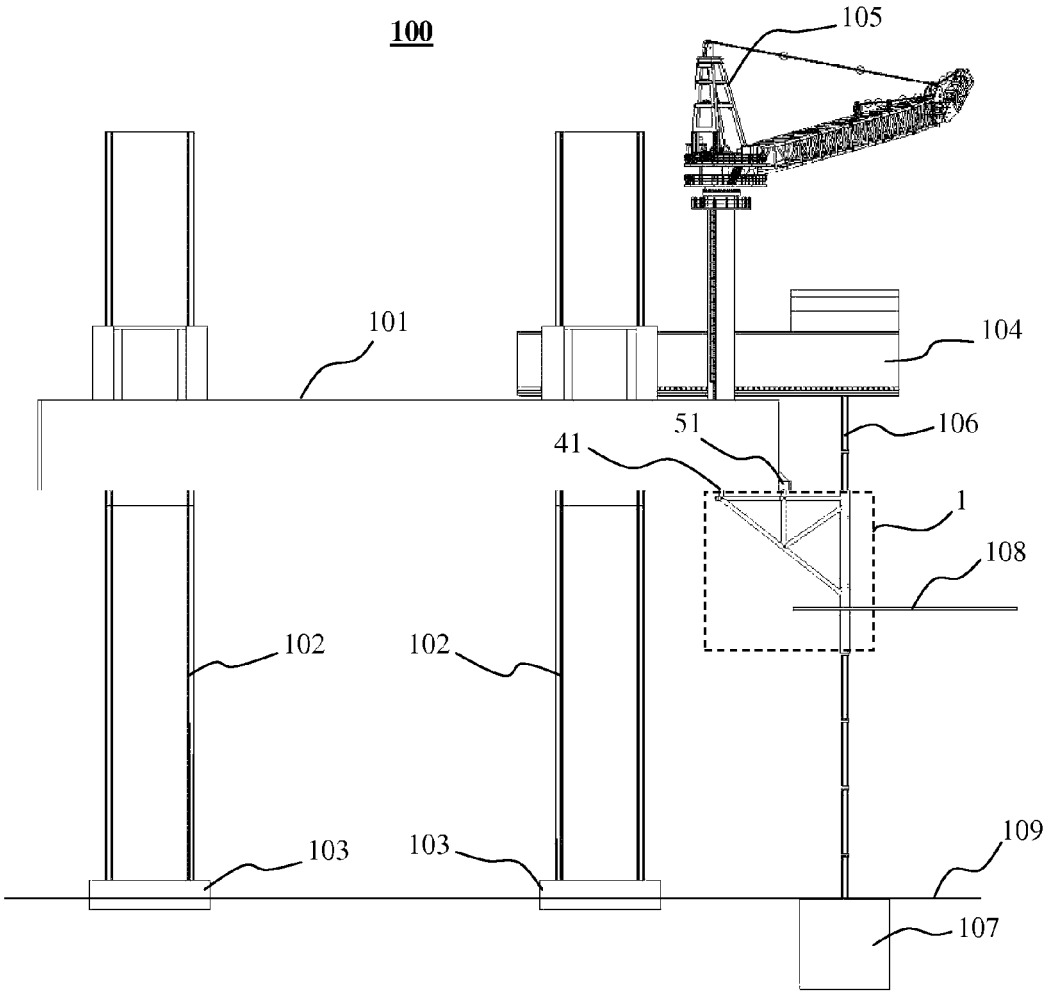
FIG. 1 shows a side view of a jackup drilling platform employing the jackup deployed riser protection structure in accordance with one embodiment of the present invention.

Referring now to FIG. 1, there is provided a side view of a jackup drilling platform employing the jackup deployed riser protection structure in accordance with one embodiment of the present invention. The jackup drilling platform 100 comprises a jackup hull 101, a plurality of legs 102 slidably passing through the jackup hull 101 for providing support to the jackup hull 101 being above the water level 108 when the platform 100 is in operation, and a plurality of spudcans 103 of which each is coupled to one of the plurality of legs 102 to provide support to the legs 102 by penetrating into the seabed 109. As shown in FIG. 1, the jackup drilling platform 100 is usually provided with operational accessories such as a cantilever structure 104 and a crane 105. Other items such as accommodations, a drilling derrick and so on are excluded from the drawings for the purpose of simplicity and not to distract from the invention. It is to be noted that while the jackup illustrated is an independent leg, cantilever type jackup, the invention could also be used on other types of jackup, including mat supported jackup units and rigs using slots rather than cantilevers. The platform 100 is provided with a riser 106 for being used during drilling operation, where the riser 106 is coupled with an output outlet located within a caisson 107 positioned below the seabed level 109. In some cases the caisson 107 shown is used, and in other cases the riser may connect directly to a fixture at or above the seabed. If unprotected, the riser 106 is vulnerable to many dangers from the water. Thus, the platform 100 is provided with a jackup deployed riser protection structure 1 for providing protections to the riser 106. In order to accommodate the riser protection structure 1, the jackup hull 101 is provided with a plurality of coupler receivers to couple with the riser protection structure 1; for instance, as shown in FIGS. 1 and 2, the plurality of coupler receivers comprises two underside coupler receivers 41 and two edge coupler receivers 51; these structures will be described in detail hereinbelow.

Figure 2:
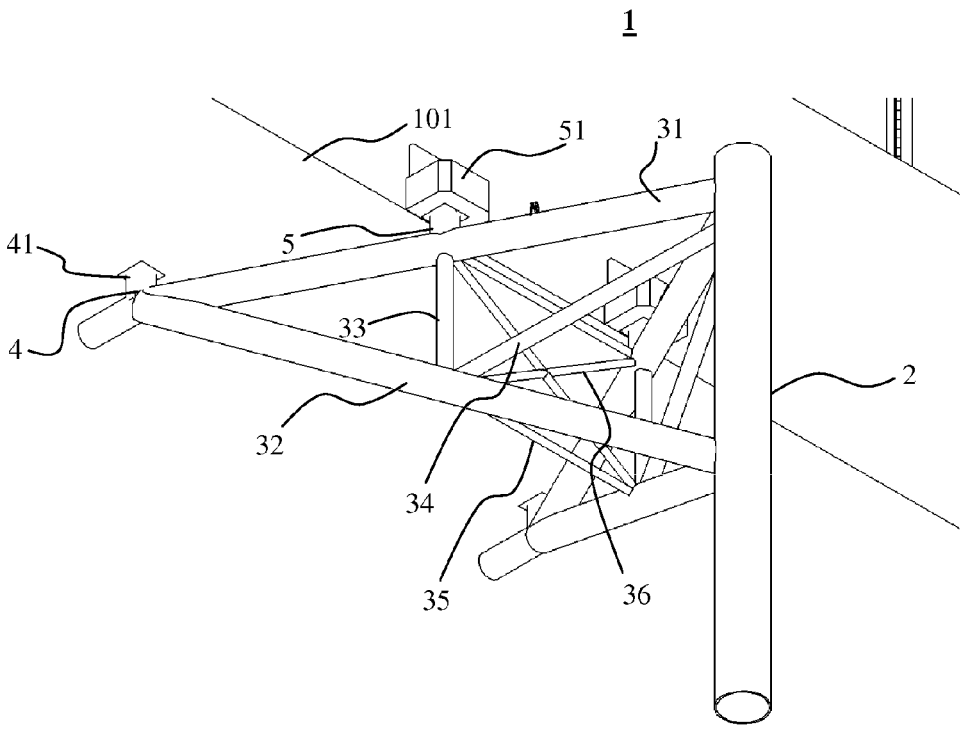
FIG. 2 shows an isometric view of the jackup deployed riser protection structure in accordance with one embodiment of the present invention.

Referring now to FIG. 2, there is provided an isometric view of the jackup deployed riser protection structure in accordance with one embodiment of the present invention. The jackup deployed riser protection structure 1 comprises a tubular sleeve 2, a support structure, and a plurality of couplers 4, 5.

Figure 3:
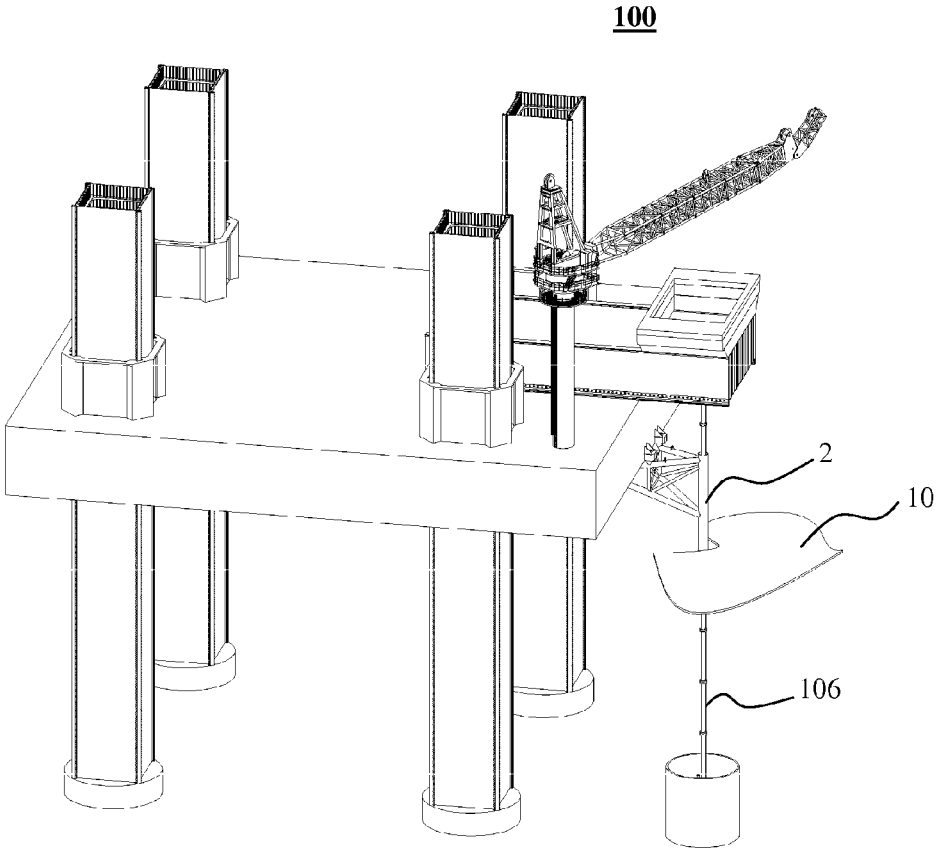
FIG. 3 shows an isometric view of the jackup drilling platform employing the jackup deployed riser protection structure in a condition of sea ice in accordance with one embodiment of the present invention.

The tubular sleeve 2 is a hollow structure that allows the riser 106 to pass through. In certain embodiments, the tubular sleeve 2 has a cylindrical configuration so as to shield the riser 106 from water borne hazards such as sea ice 10 as shown in FIG. 3.

In some embodiments, the tubular sleeve is a complete tubular, providing full shielding to the riser. In other embodiments, the tubular sleeve is a partial tubular and may not provide a full shielding function. In this case the riser may be subject to local ice loading however the tubular sleeve protects the riser by providing a supporting function which means the riser does not need to carry the loads back to the jackup.

The support structure comprises two triangle frames extending from the tubular sleeve 2 at a predetermined angle, where each triangle frame comprises a horizontal beam 31 with one proximity end and a distal end, a slope beam 32 with one proximity end and a distal end, a vertical beam 33 with one top end and a bottom end, and a diagonal beam 34 with one proximity end and a distal end. The proximity ends of the horizontal beam 31 and slope beam 32 are coupled to the tubular sleeve 2 at higher coupling points and the proximity end of the diagonal beam 34 to the tubular sleeve 2 at a lower coupling point. The distal ends of the horizontal and slope beams 31,32 are coupled to form a distal juncture. The distal end of the diagonal beam 34 is coupled to the slope beam 32 at a middle point. The top and bottom ends of the vertical beam 33 are coupled to a middle point of the horizontal and slope beams 31, 32, respectively. The two triangle frames are braced by two horizontal members 35 and two cross members 36, where all four brace members are coupled to the middle points of the horizontal beam 31 and slope beam 32. Each triangle frame further comprises a distal coupler 4 located at the distal juncture, and a middle coupler 5 located at the middle point of the horizontal beam 31. The distal coupler 4 and middle coupler 5 are coupled to the underside coupler receiver 41 and edge coupler receiver 51 respectively.

The support structure is coupled to the tubular sleeve 2 at an elevation close to the water level 108 so that it can provide strong support to the tubular sleeve 2. While the lower coupling point as shown in FIG. 3 is above the water level 108 to avoid additional impact from ice to the support structure, it would be possible for the coupling point to be at or below the water level in other embodiments. The arrangement of the beams 31, 32, 33, 34 and brace members 35, 36 described herein is only one example of the possible arrangement of members required to form a strong support structure coupling the tubular sleeve 2 to the jackup hull 101. It is understood that alternative arrangements of these members could be used to provide the required support. The illustrated arrangement is intended however to offer a preferred embodiment in which a strong frame is achieved using relatively few members.

Figure 4:
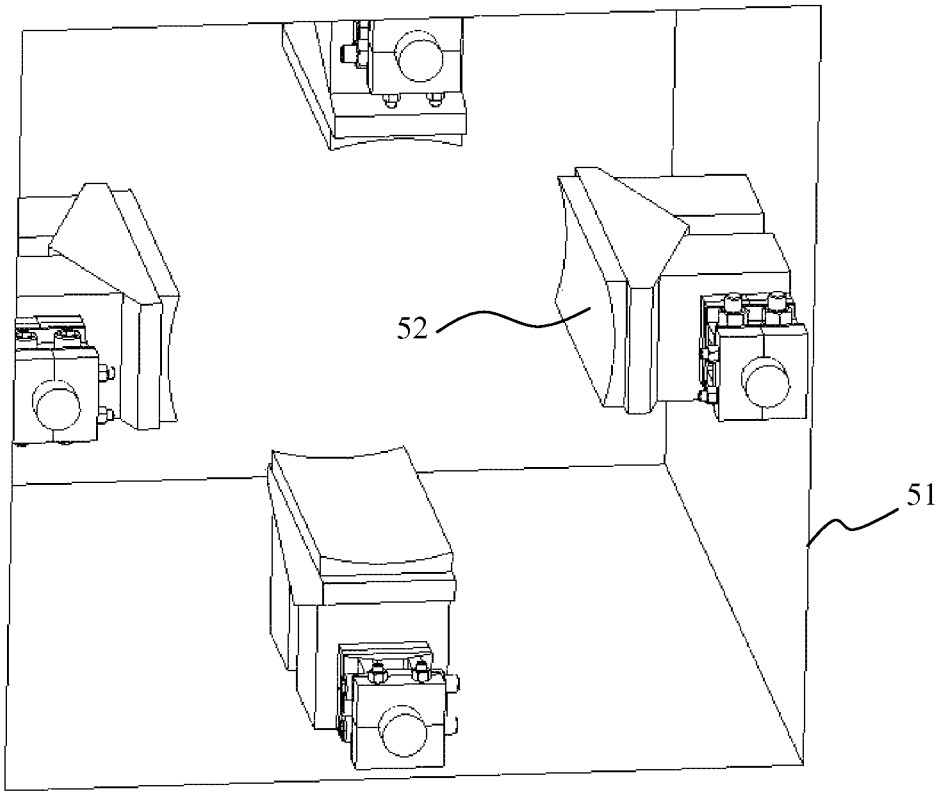
FIG. 4 shows an exemplary clamped coupling means in accordance one embodiment of the present invention.

The coupler receivers 41, 51 can be any suitable coupling means including for example a flanged coupling means, pinned coupling means, clamped coupling means or a combination of these. As shown in FIG. 4, there is provided an exemplary clamped coupling means to lock onto the coupler with a tubular configuration. The coupler receiver 51 (similar to 41) comprises an arrangement of four clamps 52 which can be engaged in order to rigidly grip the coupler 5. While four clamps are shown, the number of clamps may be varied depending on the loads to be carried and the arrangement of the support structure. In this case the riser protection structure 1 couples to the bottom edge and underside of the hull, but it is appreciated that coupling points could also be provided on the aft wall (transom) of the hull. The coupler can also be designed to incorporate a degree of adjustability to allow for the horizontal position riser protection structure to be adjusted slightly. This may be done for example by allowing some range of motion of clamps, by including means of shimming, or by allowing alternative connection points. This may be beneficial if repositioning the unit over an existing well.

Figure 5:
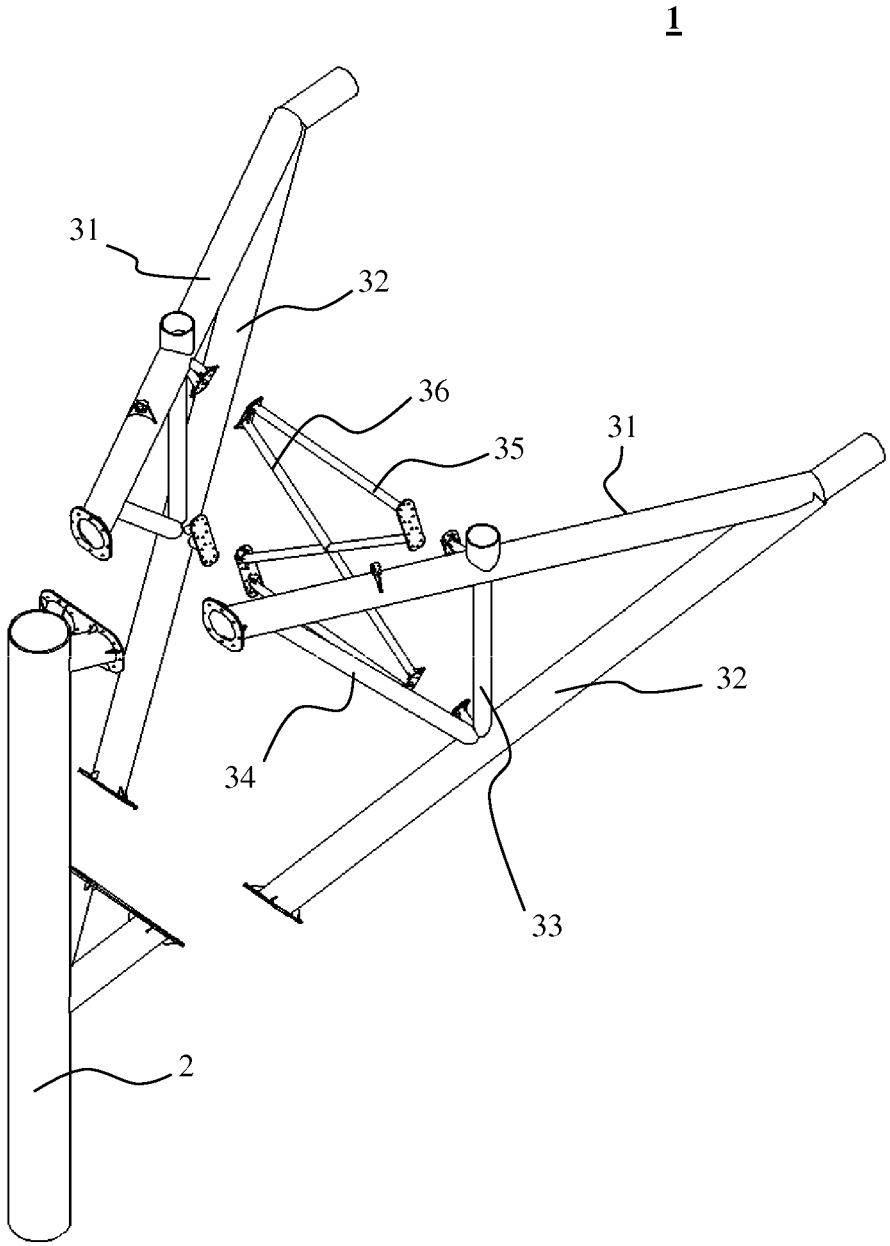
FIG. 5 illustrates an exemplary modular approach for installing the jackup deployed riser protection structure as shown in FIG. 2.
Figure 6:
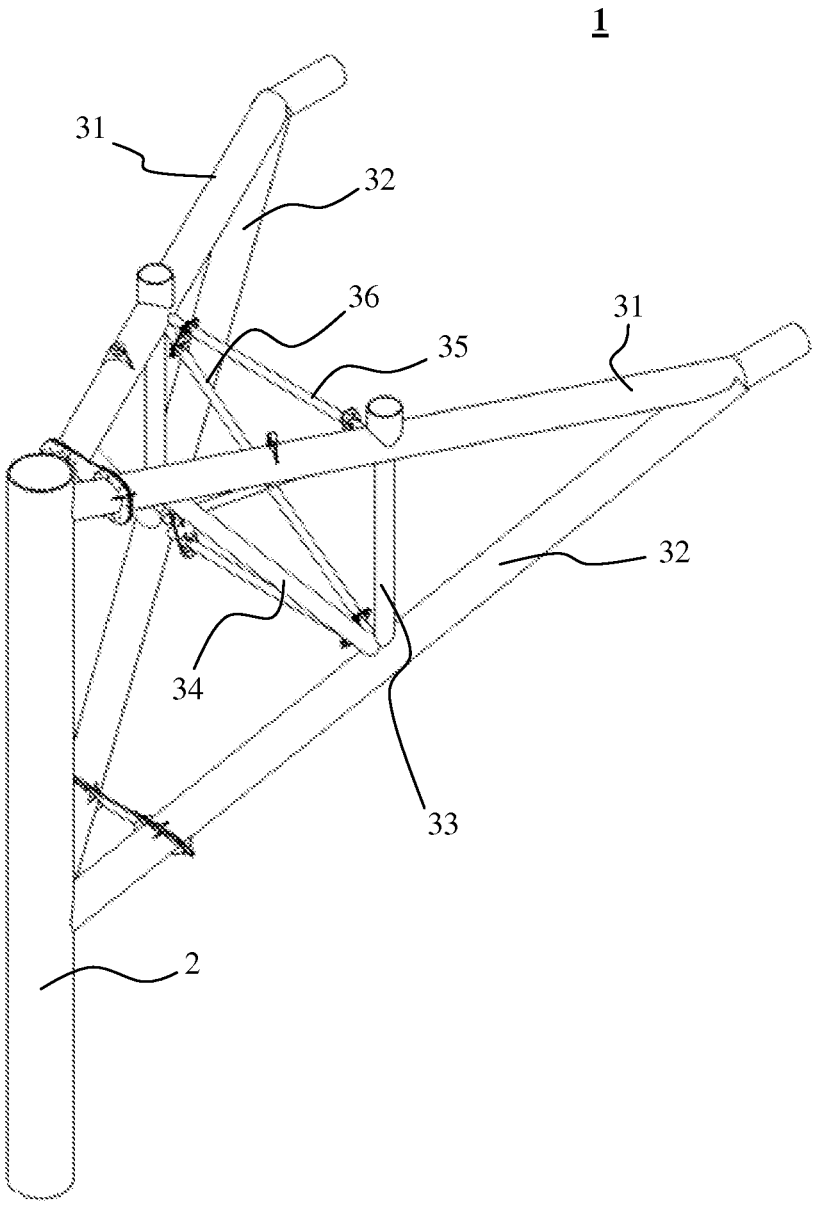
FIG. 6 shows the assembled jackup deployed riser protection structure using the modular approach shown in FIG. 5.

Referring now to FIG. 5, there is provided an exemplary modular approach for installing the jackup deployed riser protection structure as shown in FIG. 2. As shown in FIG. 5, all components of the riser protection structure 1 are grouped into 4 modules that are assembled on the jackup hull 101 prior to deployment. Allowing the structure to be dismantled in this way would allow for more compact storage and transport onboard the jackup or on a supply vessel. The connections here are shown as flanged connections to be fastened by bolting. It would be possible to use other couplers such as clamps, pins etc for these connections. FIG. 6 shows that the 4 modules are assembled into the jackup deployed riser protection structure 1.

Figure 7:
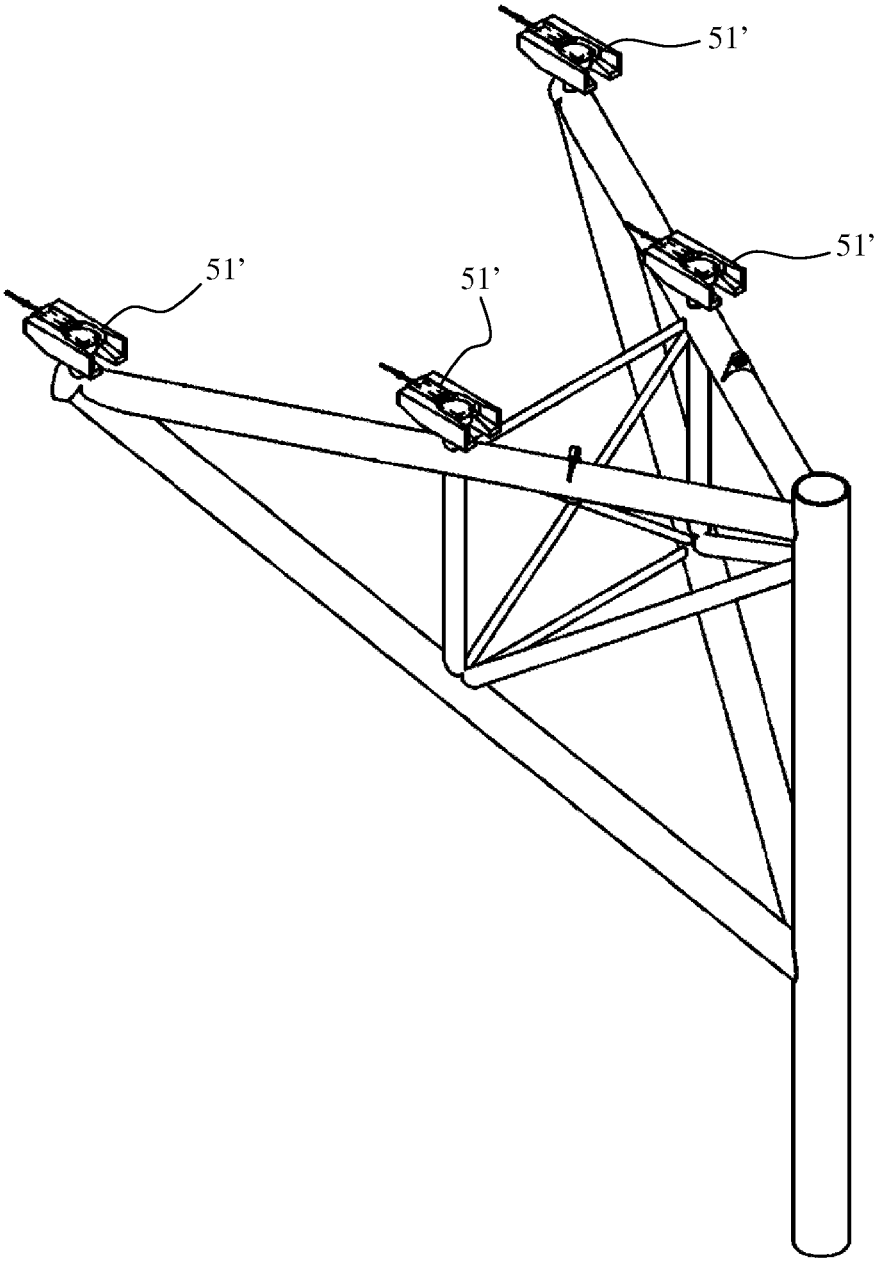
FIG. 7 shows an isometric view of the jackup deployed riser protection structure with an alternative horizontal coupler receiver in accordance with one embodiment of the present invention.
Figure 8:
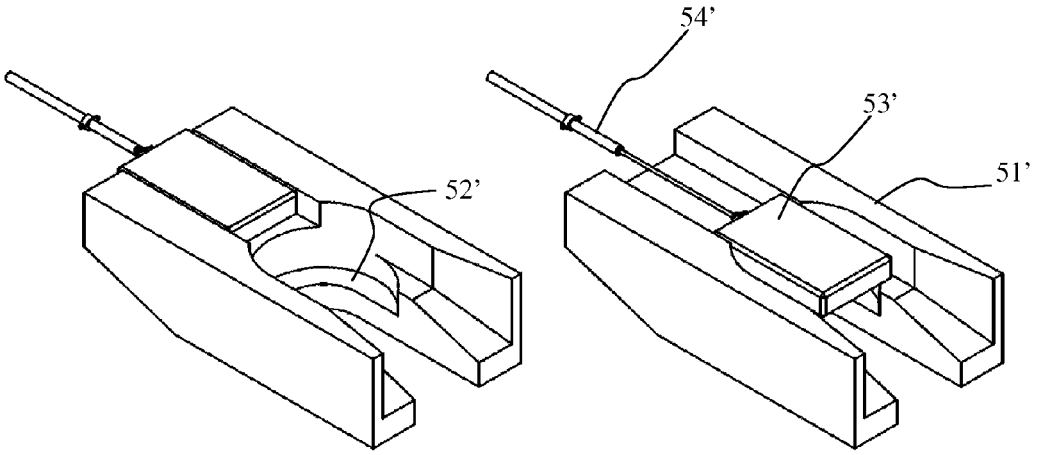
FIG. 8 shows an isometric view of the horizontal coupler receiver in accordance with one embodiment of the present invention.
Figure 9:
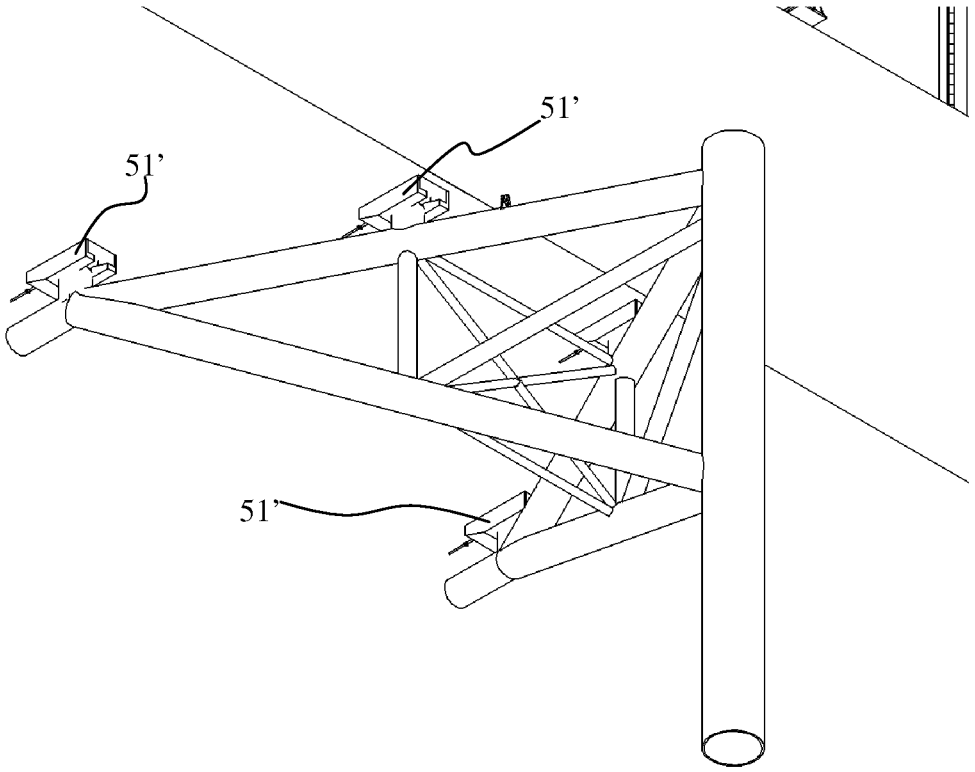
FIG. 9 shows the jackup deployed riser protection structure being coupled with the jackup hull.

Referring now to FIG. 7, there is provided an isometric view of the jackup deployed riser protection structure with an alternative horizontal coupler receiver in accordance with one embodiment of the present invention. FIG. 8 shows an isometric view of the horizontal coupler receiver. FIG. 9 shows the jackup deployed riser protection structure being coupled with the jackup hull 101. In the coupler receiver shown in FIG. 8, the coupler would be horizontally pushed or pulled into the coupler receiver 51' where it would slide into place and settle into the recess provided 52'. The locking plate 53' would then be slid into position using the sliding means 54' in order to lock the coupler in place. This arrangement would require the sliding means to be provided with a means of activation such as hydraulic actuators. In a similar embodiment (not shown), the recess 52' and locking plate 53' could be excluded and the coupler could simple be pushed into the coupler receiver and then held in position by locking off the lateral motion at the transom. This could be achieved using simple drop in pins or by using sliding means such as hydraulics which could be also used for sliding the structure in and out of the coupler receivers.

Figure 10:
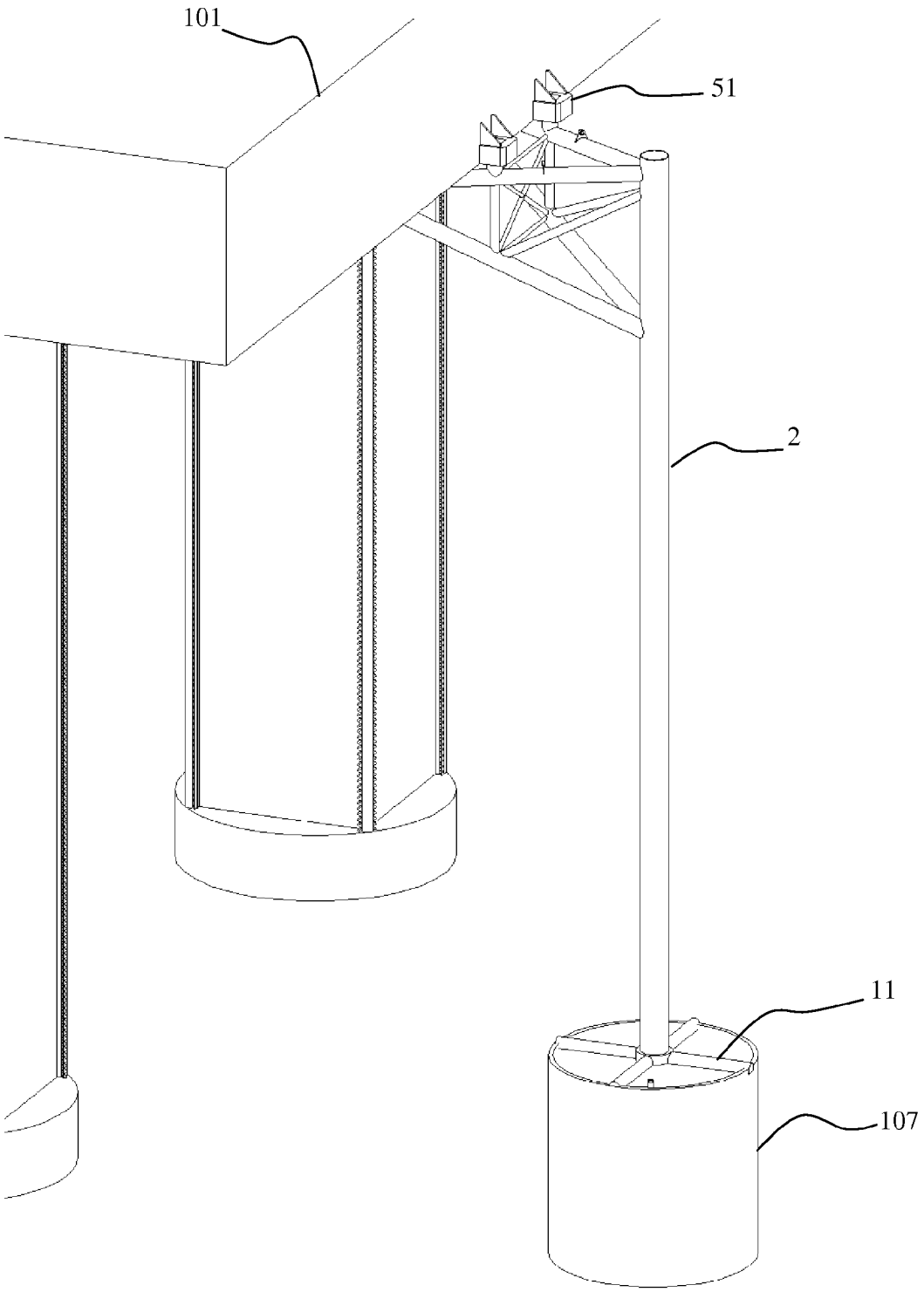
FIG. 10 shows an isometric view of the jackup deployed riser protection structure in accordance with another embodiment of the present invention.

Referring now to FIG. 10, there is provided an isometric view of the jackup deployed riser protection structure in accordance with another embodiment of the present invention. In this embodiment, the tubular sleeve 2 extends to a supporting means 11 that is coupled to a subsea caisson 107. When drilling in areas subject to sea ice it is sometimes necessary to provide a subsea caisson below the seabed in order to protect the top of the well. In this case a supporting means 11 can be designed to be coupled to the caisson and the tubular sleeve 2, providing additional support to the tubular sleeve 2 and therefore extending the capability of the riser protection structure 1.

Figure 11:
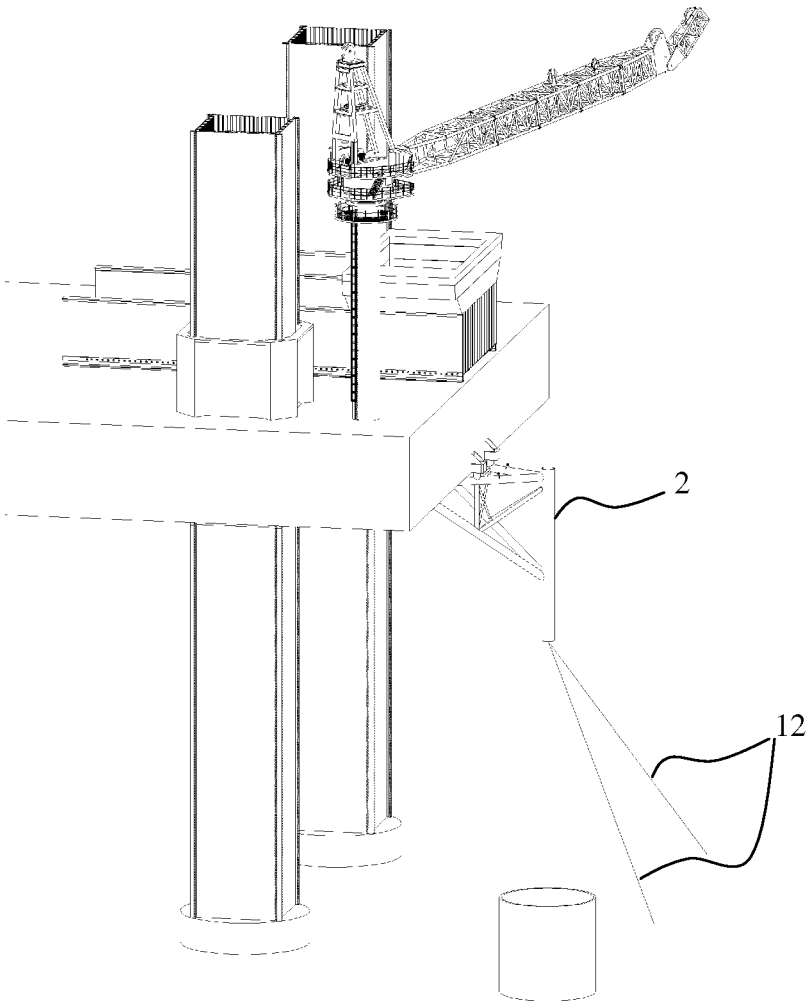
FIG. 11 shows an isometric view of the jackup deployed riser protection structure in accordance with another embodiment of the present invention.

Referring now to FIG. 11, there is provided an isometric view of the jackup deployed riser protection structure in accordance with another embodiment of the present invention. The tubular sleeve 2 is coupled to taut mooring lines 12 that provide additional strength and stiffness to the riser protection structure. In the embodiment shown, two mooring lines are shown, extending aft of the Jackup in order to provide additional support in the case of ice loads approaching substantially from the aft side of the jackup. In other cases a single mooring line may be used or the number of mooring lines may be increased and mooring lines may be deployed over a range of angles to cover expected ice approach directions.

Figure 12:
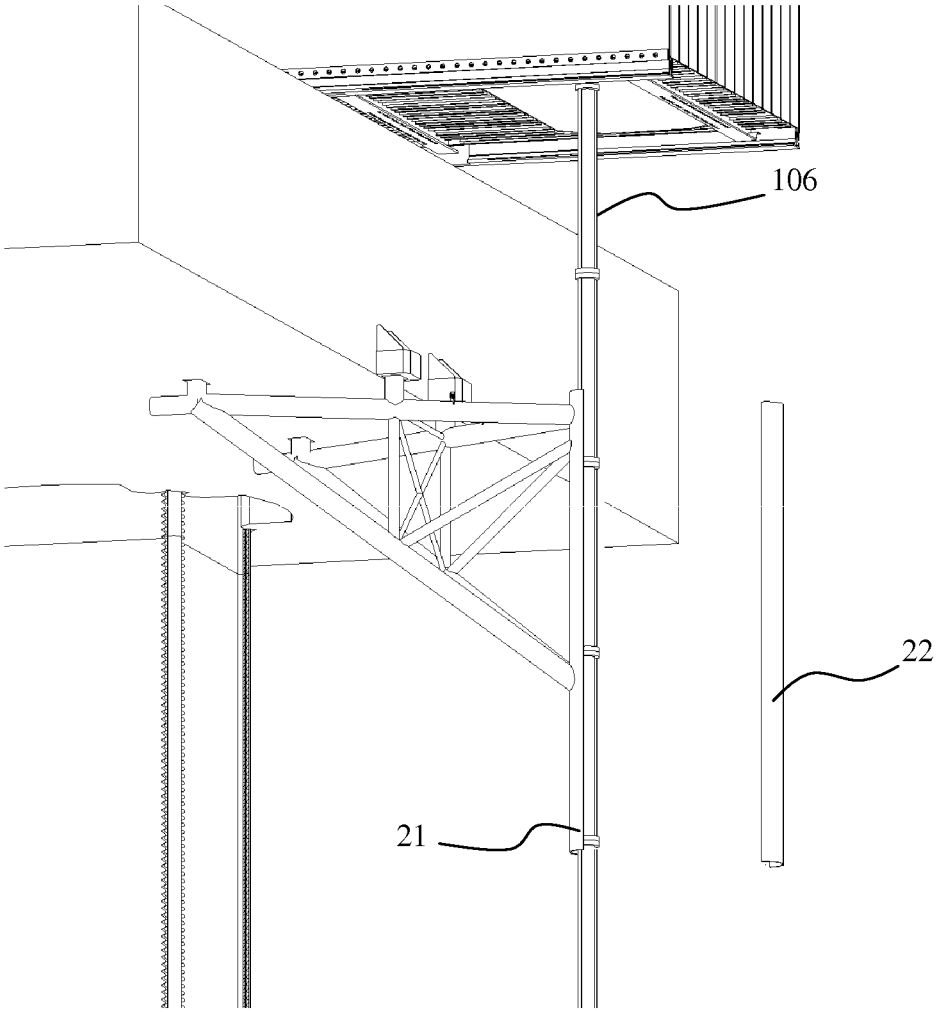
FIG. 12 shows an isometric view of the jackup deployed riser protection structure in accordance with another embodiment of the present invention.
Figure 13:
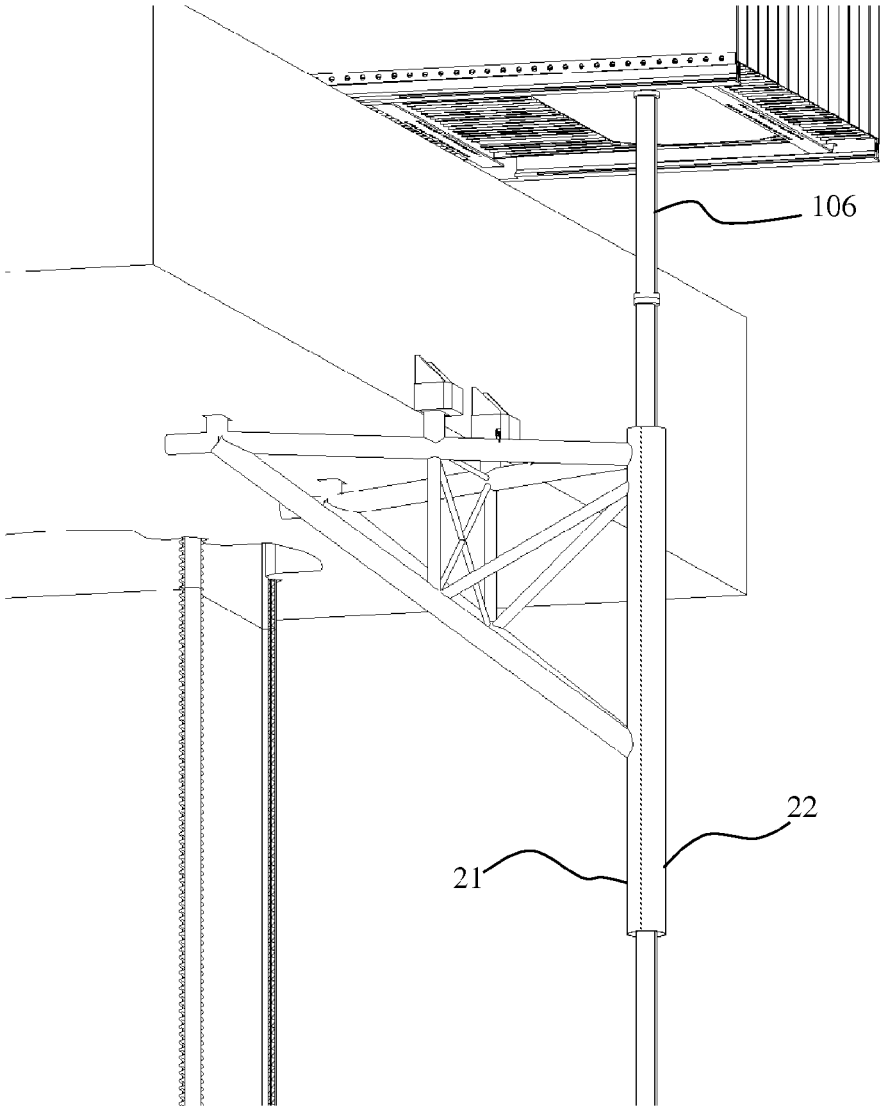
FIG. 13 shows an isometric view of the jackup deployed riser protection structure as shown in FIG. 12 in the assembled configuration.

Referring now to FIGS. 12 and 13, there are provided isometric views of the jackup deployed riser protection structure in accordance with another embodiment of the present invention. The tubular sleeve 2 comprises one partial tubular 21 for coupling to the support structure and another partial tubular 22 that is separable from the part 21. When the two partial tubulars 21, 22 are assembled, they protect the riser 106. This embodiment allows installation and removal of the riser protection structure while the riser is in place. While FIGS. 12 and 13 show that the partial tubular 22 is completely separable from the part 21, it may be movably coupled to the partial tubular 21, for example by using hinges.

Figure 14:
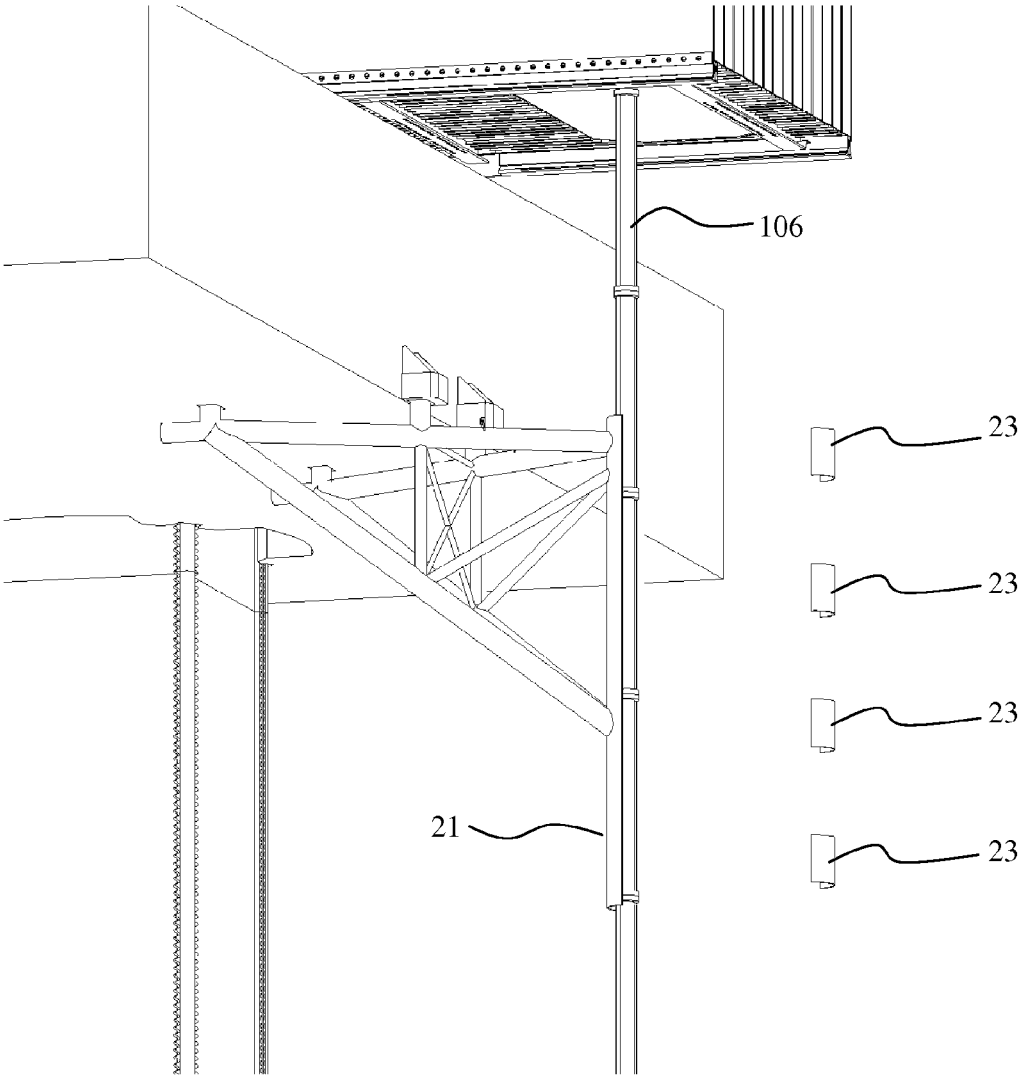
FIG. 14 shows an isometric view of the jackup deployed riser protection structure in accordance with another embodiment of the present invention.
Figure 15:
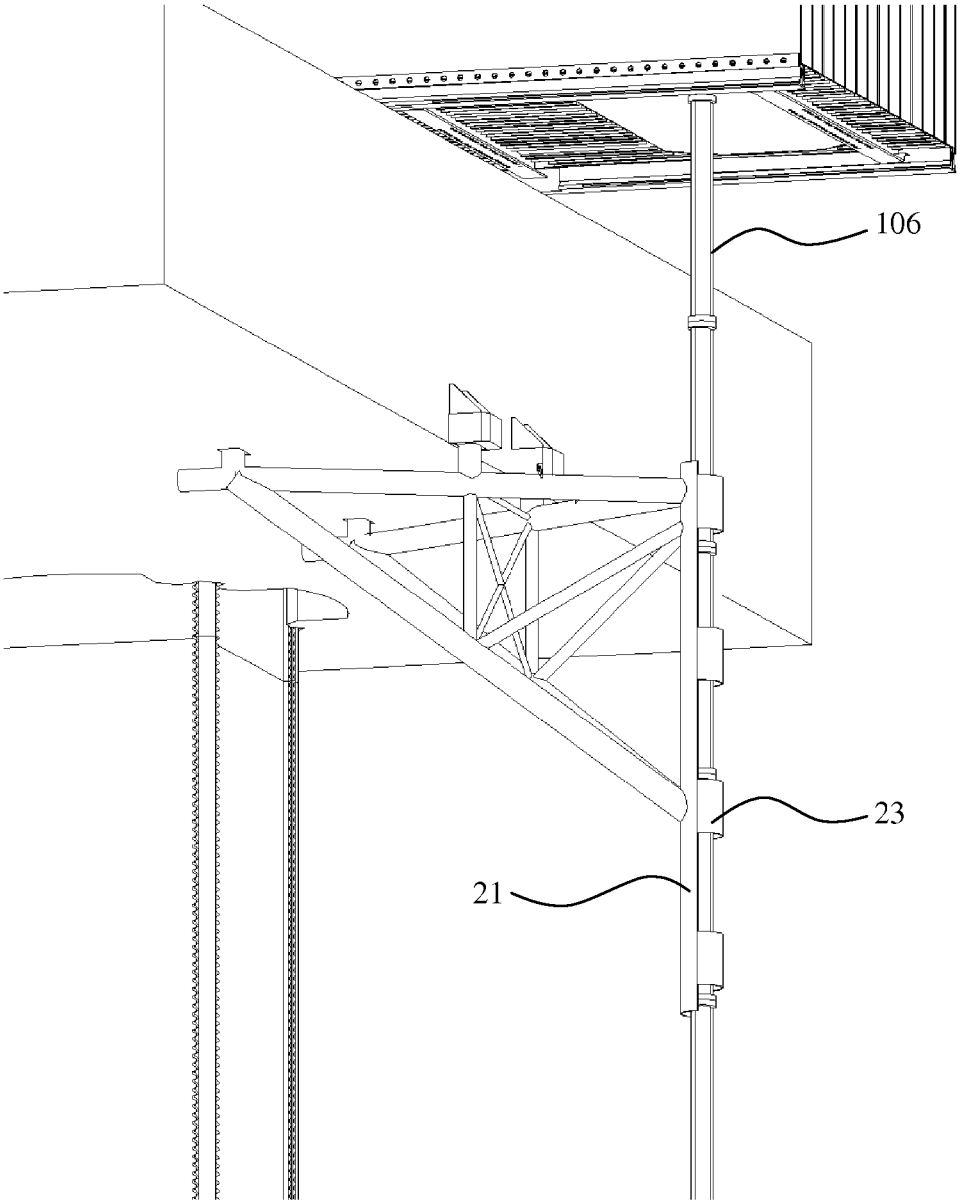
FIG. 15 shows an isometric view of the jackup deployed riser protection structure as shown in FIG. 14 in the assembled configuration.

Referring now to FIGS. 14 and 15, there are provided isometric views of the jackup deployed riser protection structure in accordance with another embodiment of the present invention. The tubular sleeve 2 comprises one partial tubular 21 for coupling to the support structure and a plurality of clamps 23. When the partial tubular and clamps 21, 23 are assembled, they protect the riser 106.

The riser protection structure 1 provides protection to the riser 106 using a tubular sleeve 2 that usually extends from a distance substantially below the water level 108 to a height above the water level 108 that exceeds the potential impact height. The tubular sleeve 2 protects the riser by deflecting and/or crushing incoming ice 10. The loads imparted on the tubular sleeve 2 are then transferred to the support structure and back to the jackup hull 101 through the couplers 4, 5 and the couple receivers 41, 51. For cases where very high loads are expected, additional supports may be provided by taut lines 12 extending to the seabed or by extension of the tubular sleeve 2 to a support structure 11 at the subsea caisson 107, increasing the strength and stiffness of the system.

In other cases the strength of the riser itself may be deemed sufficient for sustaining the local ice forces and the protection structure simply provides support to the riser in order to break the riser span and more effectively transfer load back to the jackup. In this case a partial tubular may be used to cradle and secure the riser. This concept is illustrated in the embodiment shown in FIGS. 14 and 15, where the partial tubular 21 supports the riser 106 using clamps 23. As with the embodiment in FIGS. 12 and 13, the clamps 23 shown in FIGS. 14 and 15 may be movably coupled to partial tubular 21, for example by using hinges.

Figure 16:
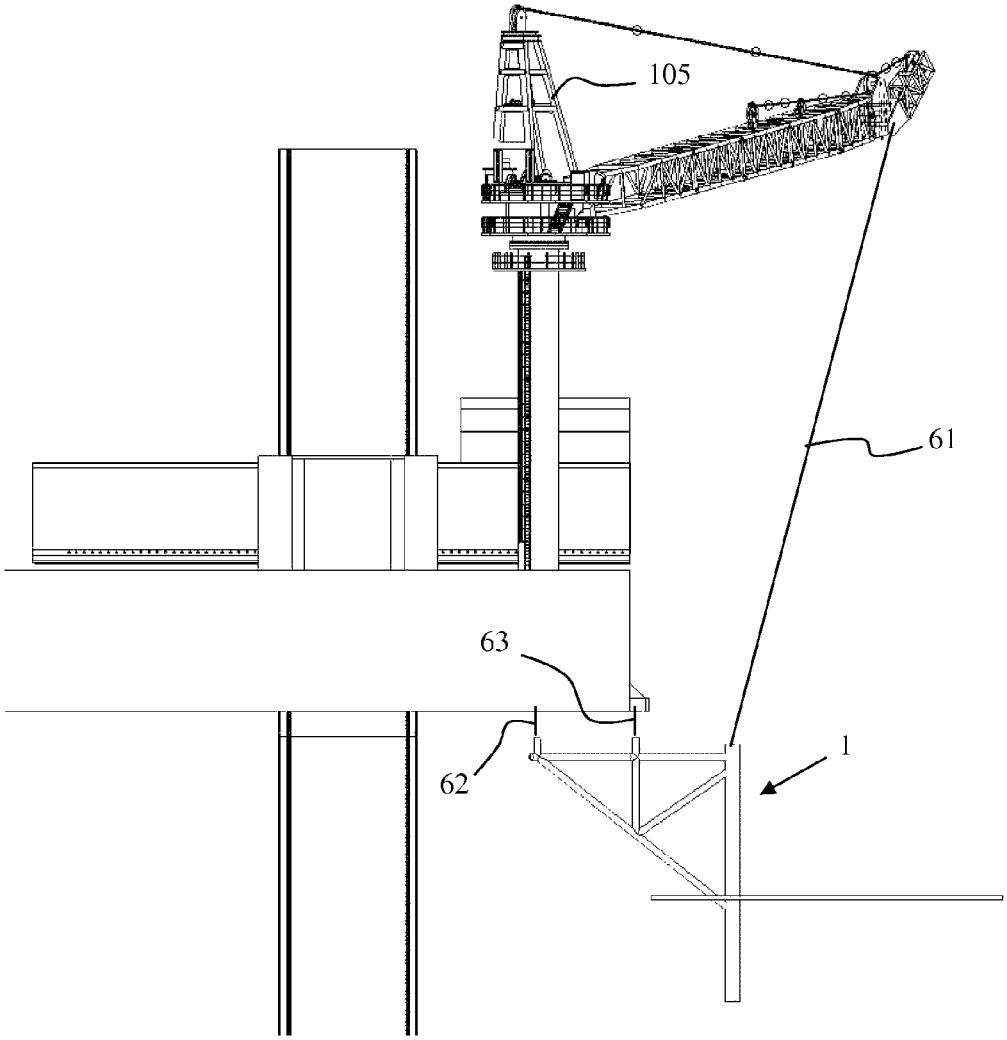
FIGS. 16-18 show the installation of the jackup deployed riser protection structure as shown in FIG. 2.
Figure 17:
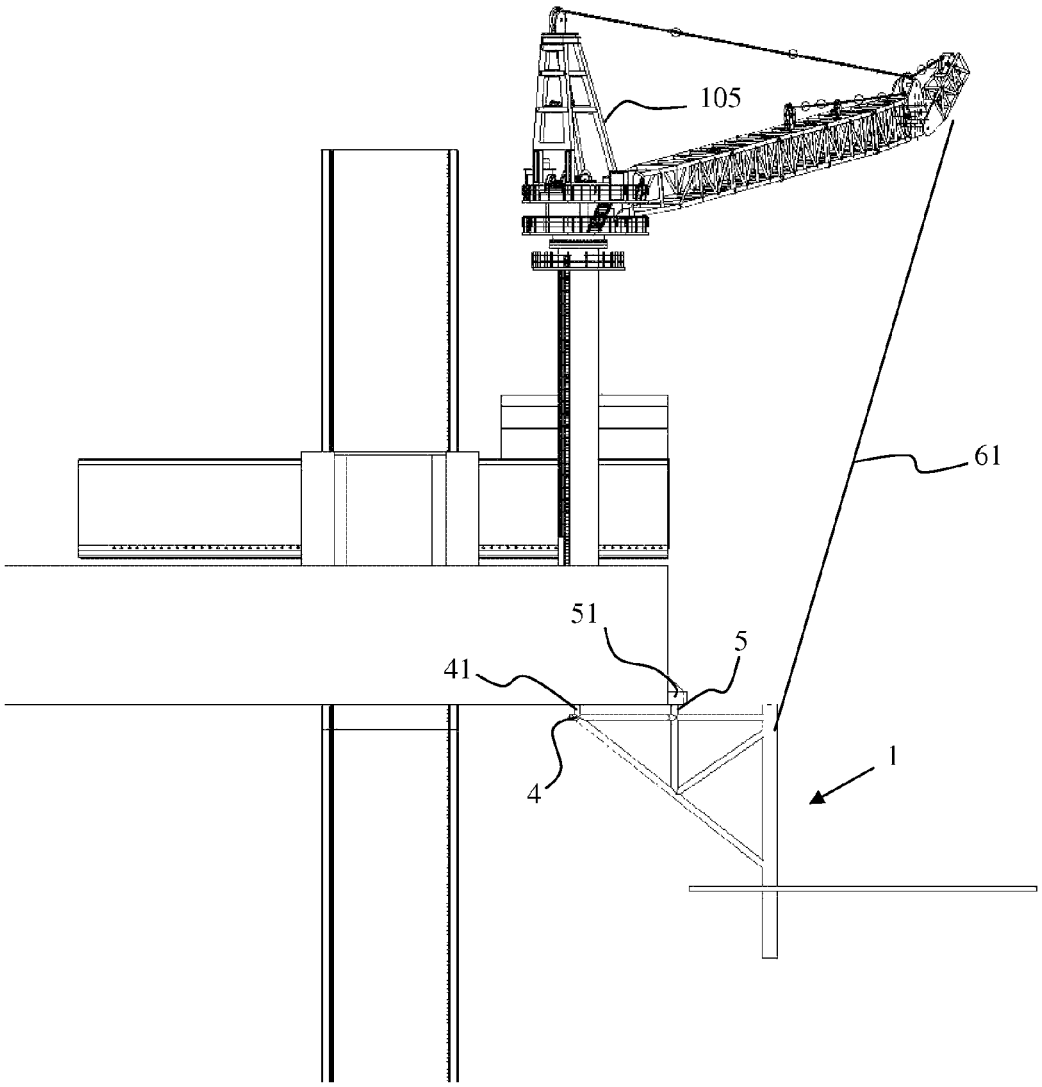
Figure 18:
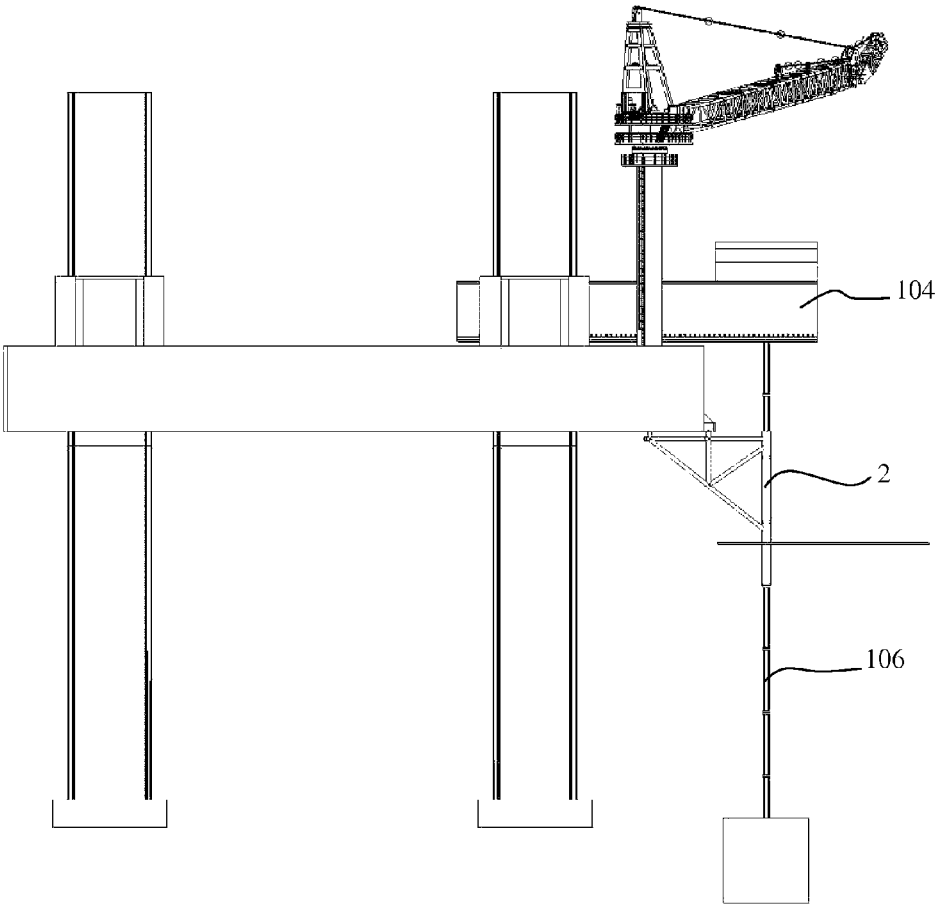
Figure 19:
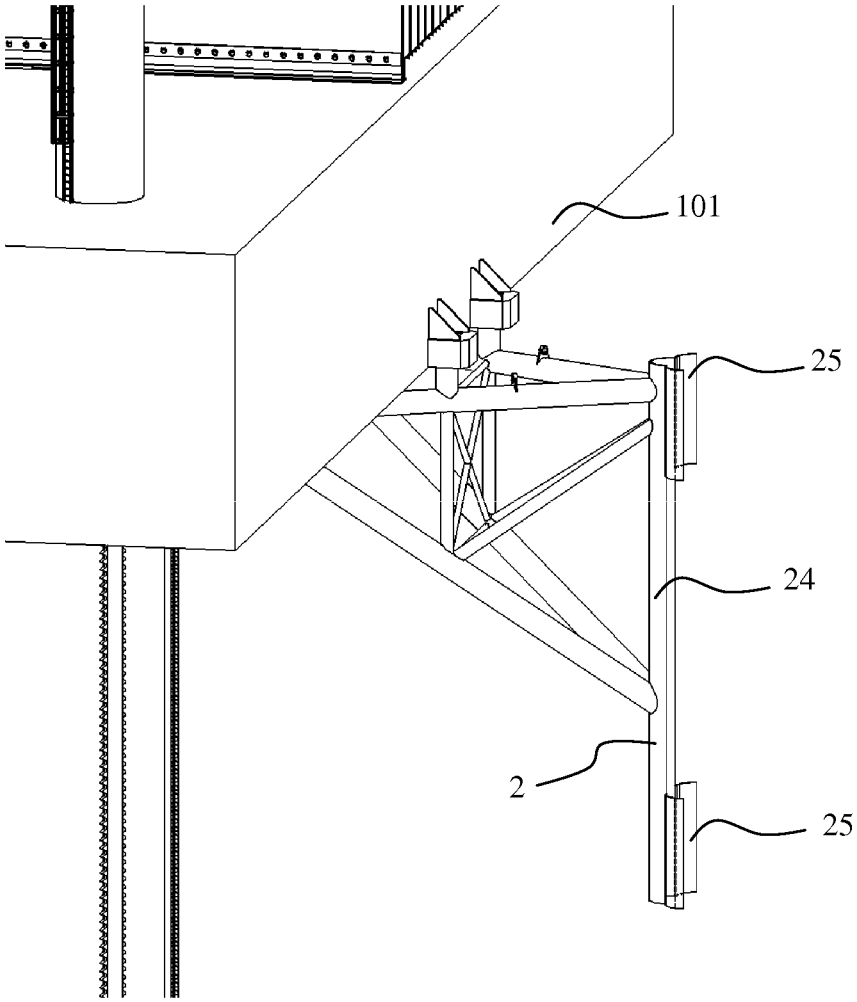
FIGS. 19-22 show the installation of the Jackup deployed riser protection structure in accordance with another embodiment of the present invention.
Figure 20:
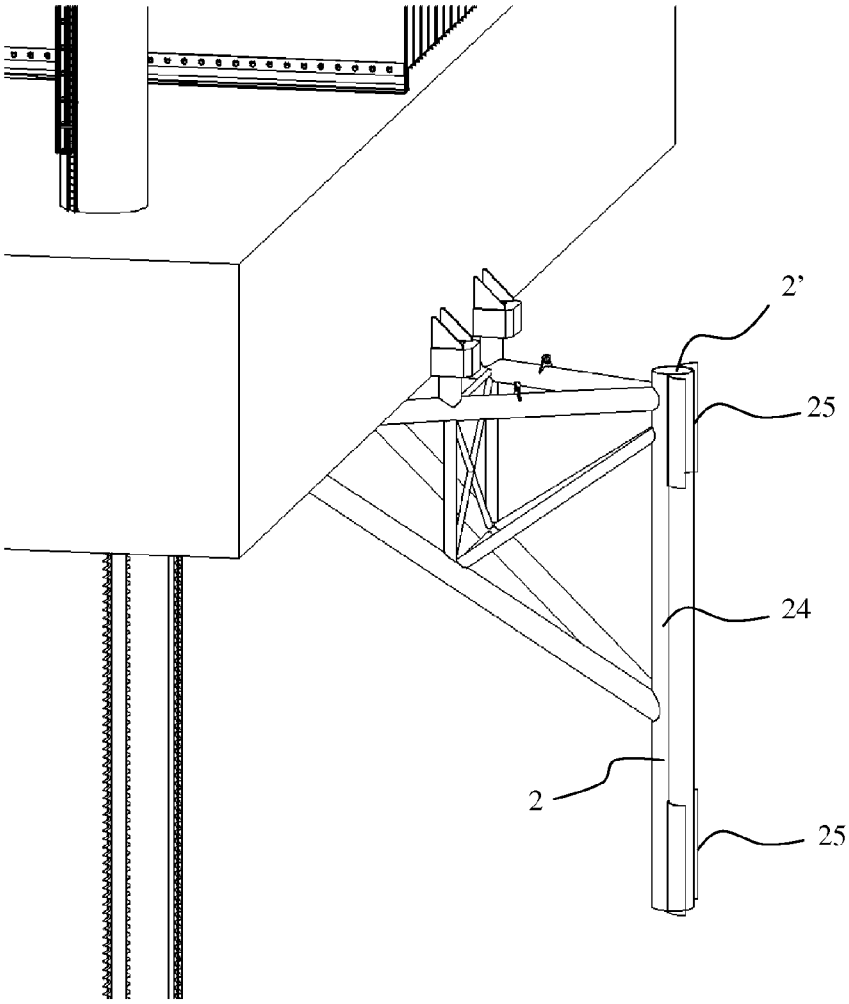

Referring now to FIGS. 16-18, there is provided an exemplary illustration of the installation of the riser protection structure as shown in FIG. 2. It would be possible to install the structure in other ways. The riser protection structure 1 may be lifted using the aft deck crane 105 by the cable 61 and lowered into a position below and behind the jackup. Winches can then be used together with the crane using cables 62, 63 to raise the couplers 4, 5 of the riser protection structure 1 into the coupler receivers 41, 51. While 4 couplers are shown in FIG. 2, the number of couplers may be different depending on the loads to be carried and the arrangement of the structure. After raising the couplers into the coupler receivers, they are secured in place, for example by bolting, clamping or other suitable means. The jackup can then proceed to drill through the tubular provided in order to carry out the required work while being protected from the incoming ice. It is to be noted that the method of pulling in with cables is just one possibility of installation. As for the horizontal coupler receivers shown in FIG. 8, they could be pulled in by hydraulics or other means.

In the above described case, the riser protection structure 1 must be installed before the riser is installed. In some cases however it may be beneficial to allow drilling to commence first and to install the riser later. In this case, the embodiments illustrated in FIGS. 12 to 15 may be used. In FIGS. 12 and 13 the tubular is provided in two parts 21, 22 such that the main structure can be installed adjacent to the riser and then the second part of the tubular 22 fitted over the riser 106 and fixed in place, for example by bolting or clamping. In FIGS. 14 and 15 a further embodiment is shown in which the second part of the tubular is excluded and the riser is instead secured to the partial tubular member 21 using for example clamps 23. In this case the riser 106 would sustain local impact forces from the ice but would be strengthened against overall deflection and bending by the support provided by the riser protection structure.

In a similar way it is appreciated that the tubular sleeve 2 may be separately installed and connected to the support structure during installation. This may be beneficial in some cases in order to reduce the weight to be lifted. This concept is further illustrated in FIGS. 19-22 and discussed below.

Figure 21:
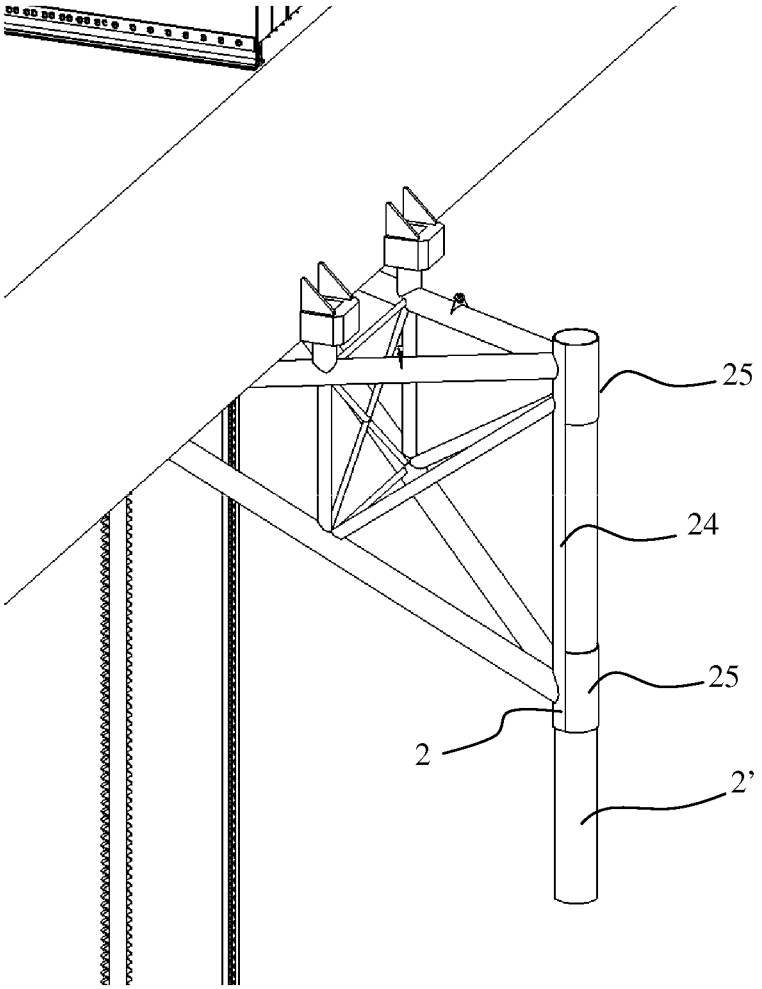
Figure 22:
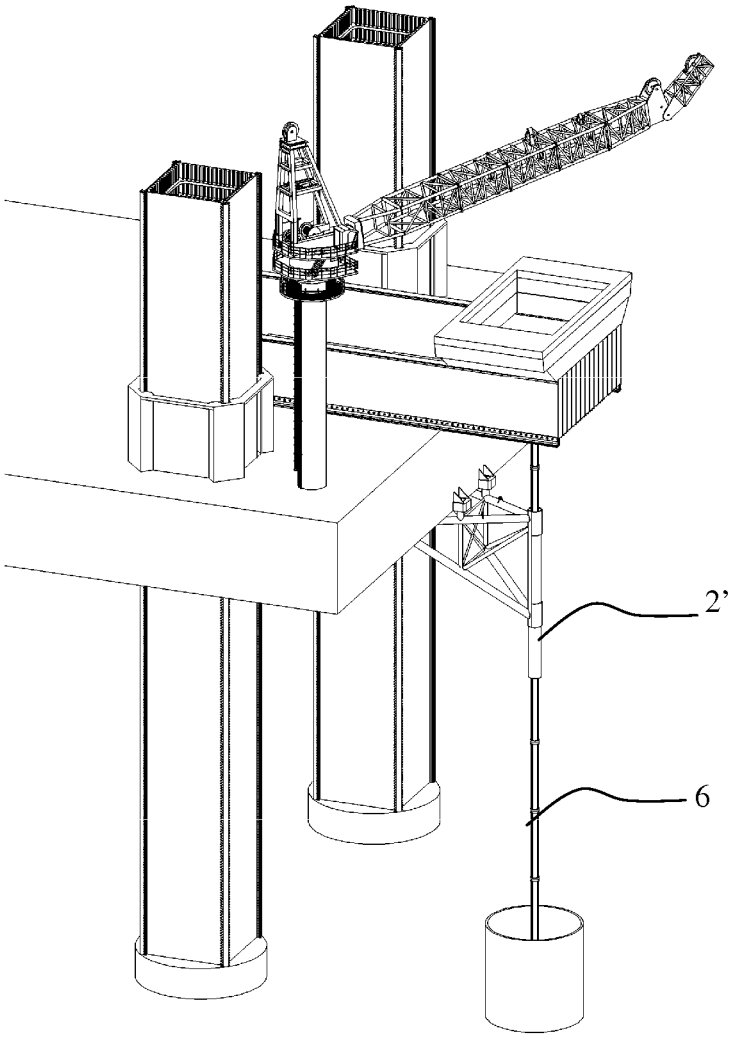

Referring now to FIGS. 19-22, there are provided isometric views of the jackup deployed riser protection structure in accordance with another embodiment of the present invention. As shown in FIGS. 19-22, the tubular sleeve 2 is comprised of a partial tubular 24 serving as a guide member, and a plurality of clamps 25 removably coupled with the partial tubular 24. After the riser protection structure 1 is installed onto the hull 101 (FIG. 19), a second tubular sleeve 2' is inserted into the tubular sleeve 2 (FIG. 20), and then the two clamps 25 are locked so as to grip the second tubular sleeve 2' (FIG. 21). While clamps are illustrated here it is to be appreciated that other methods of installing and securing the tubular to the main support frame are possible. These include bolting to attached flanges, or vertically slotting the tubular into sleeves on the support structure. The option of vertically slotting the tubular 2' into sleeves on the support structure is attractive as it allows installation of the tubular without significant clamping means.

The removal of the riser protection structure will be necessary for example;

1. If the drilling operation is complete;
2. If exceptionally large objects are expected to impact the structure. For example, this may be from an incoming ice feature that exceeds the designed capacity of the structure.

The removal method would essentially be carried out in the reverse way to installation. In some cases this therefore means that the riser must be removed first and then the riser protection device removed. In case of an emergency however, as long as sufficient water depth were present, it may be possible to jack down with the riser protection structure still in place.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. A jackup deployed riser protection structure comprising:
- a plurality of coupler receivers disposed onto a jackup hull;
- a tubular sleeve, wherein the tubular sleeve is a hollow structure that allows a riser to pass through;
- a support structure coupled with the tubular sleeve to provide support for the tubular sleeve; and
- a plurality of couplers coupled with the support structure, wherein each of the plurality of couplers is coupled with one of the plurality of coupler receivers, so that the jackup deployed riser protection structure is supported by the jackup hull in order to provide protection to the riser;
- wherein the support structure comprises two triangle frames extending from the tubular sleeve at a predetermined angle;
- wherein each triangle frame comprises:
  - a horizontal beam with one proximity end and a distal end;
  - a slope beam with one proximity end and a distal end;
  - a vertical beam with one top end and a bottom end; and
  - a diagonal beam with one proximity end and a distal end;
  - wherein the proximity ends of the horizontal beam and slope beam are coupled to the tubular sleeve at higher coupling points and the proximity end of the diagonal beam to the tubular sleeve at a lower coupling point;
  - wherein the distal ends of the horizontal and slope beams are coupled to form a distal juncture;
  - wherein the distal end of the diagonal beam is coupled to the slope beam at a middle point; and
  - wherein the top and bottom ends of the vertical beam are coupled to a middle point of the horizontal and slope beams respectively.

2. The jackup deployed riser protection structure of claim 1, wherein the support structure further comprises two horizontal members and two cross members for bracing the two triangle frames; wherein all four brace members are coupled to the middle points of the horizontal beam and slope beam.

3. The jackup deployed riser protection structure of claim 1, wherein each of the triangle frames is disposed with at least two of the plurality of couplers at the distal juncture and the middle point of the horizontal beam.

4. A jackup drilling platform comprising:

a jackup hull;

a plurality of legs slidably passing through the jackup hull for providing support to the jackup hull;

a riser for being used during drilling operation; and a jackup deployed riser protection structure comprising:

a plurality of coupler receivers disposed onto a jackup hull;

a tubular sleeve, wherein the tubular sleeve is a hollow structure that allows the riser to pass through;

a support structure coupled with the tubular sleeve to provide support for the tubular sleeve; and a plurality of couplers coupled with the support structure, wherein each of the plurality of couplers is coupled with one of the plurality of coupler receivers, so that the jackup deployed riser protection structure is supported by the jackup hull in order to provide protection to the riser;

wherein the support structure comprises two triangle frames extending from the tubular sleeve at a predetermined angle;

wherein each triangle frame comprises:

a horizontal beam with one proximity end and a distal end;

a slope beam with one proximity end and a distal end;

a vertical beam with one top end and a bottom end; and a diagonal beam with one proximity end and a distal end;

wherein the proximity ends of the horizontal beam and slope beam are coupled to the tubular sleeve at higher coupling points and the proximity end of the diagonal beam to the tubular sleeve at a lower coupling point;

wherein the distal ends of the horizontal and slope beams are coupled to form a distal juncture;

wherein the distal end of the diagonal beam is coupled to the slope beam at a middle point; and wherein the top and bottom ends of the vertical beam are coupled to a middle point of the horizontal and slope beams respectively.

5. The jackup drilling platform of claim 4, wherein the support structure further comprises two horizontal members and two cross members for bracing the two triangle frames; wherein all four brace members are coupled to the middle points of the horizontal beam and slope beam.

6. The jackup drilling platform of claim 4, wherein each of the triangle frames is disposed with at least two of the plurality of couplers at the distal juncture and the middle point of the horizontal beam.

* * * * *